US010553140B2

(12) United States Patent
Du et al.

(10) Patent No.: US 10,553,140 B2
(45) Date of Patent: Feb. 4, 2020

(54) INVERSION CONTROL CIRCUIT, METHOD FOR DRIVING THE SAME, DISPLAY PANEL, AND DISPLAY DEVICE

(71) Applicants: BOE Technology Group Co., Ltd., Beijing (CN); Hefei Xinsheng Optoelectronics Technology Co., Ltd., Hefei, Anhui (CN)

(72) Inventors: Ruifang Du, Beijing (CN); Xiping Wang, Beijing (CN); Rui Ma, Beijing (CN); Xiaoye Ma, Beijing (CN)

(73) Assignees: BOE Technology Group Co., Ltd., Beijing (CN); Hefei Xinsheng Optoelectronics Technology Co., Ltd., Hefei, Anhui (CN)

( * ) Notice: Subject to any disclaimer, the term of this patent is extended or adjusted under 35 U.S.C. 154(b) by 0 days.

(21) Appl. No.: 15/759,029

(22) PCT Filed: Sep. 22, 2017

(86) PCT No.: PCT/CN2017/103036
§ 371 (c)(1),
(2) Date: Mar. 9, 2018

(87) PCT Pub. No.: WO2018/157589
PCT Pub. Date: Sep. 7, 2018

(65) Prior Publication Data

US 2019/0378447 A1 Dec. 12, 2019

(30) Foreign Application Priority Data

Feb. 28, 2017 (CN) ..... 2017 2 0186107 U

(51) Int. Cl.
*G09G 3/20* (2006.01)

(52) U.S. Cl.
CPC ..... *G09G 3/20* (2013.01); *G09G 2300/0408* (2013.01); *G09G 2300/0426* (2013.01);
(Continued)

(58) Field of Classification Search
CPC .. G09G 3/20; G09G 2300/08; G09G 2310/08; G09G 2300/0408;
(Continued)

(56) References Cited

U.S. PATENT DOCUMENTS

2008/0101529 A1 5/2008 Tobita
2016/0105184 A1* 4/2016 Qian ..... H03K 19/0944 345/214

(Continued)

FOREIGN PATENT DOCUMENTS

CN 102208168 B 2/2016
CN 206505709 U 9/2017
JP 2005143068 A 2/2005

OTHER PUBLICATIONS

PCT/CN2017/103036 International Search Report dated Dec. 15, 2017.

*Primary Examiner* — Andrew Sasinowski
(74) *Attorney, Agent, or Firm* — Arent Fox LLP; Michael Fainberg

(57) ABSTRACT

Embodiments of the present disclosure invention disclose an inversion control circuit, a method for driving the same, a display panel, and a display device, and the inversion control circuit includes: an input circuit, a switching control circuit, a first output circuit, and a second output circuit. In the inversion control circuit according to the embodiment of the present disclosure, the four circuits cooperate with each other to thereby enable the potential of an input signal end to be opposite to the potential of an inverted signal output end, so that when the inversion control circuit is applicable
(Continued)

to the display panel, a clock signal is used as an input signal, and an output signal is a clock signal opposite in phase.

20 Claims, 10 Drawing Sheets

(52) U.S. Cl.
CPC . *G09G 2300/08* (2013.01); *G09G 2310/0267* (2013.01); *G09G 2310/0286* (2013.01); *G09G 2310/08* (2013.01)

(58) Field of Classification Search
CPC ... G09G 2300/0426; G09G 2310/0267; G09G 2310/0286
See application file for complete search history.

(56) References Cited

U.S. PATENT DOCUMENTS

| | | | | |
|---|---|---|---|---|
| 2016/0351109 | A1* | 12/2016 | Han | G09G 3/20 |
| 2018/0059823 | A1* | 3/2018 | Chang | G06F 3/0416 |
| 2018/0059829 | A1 | 3/2018 | Chen et al. | |

* cited by examiner

INVERSION CONTROL CIRCUIT, METHOD FOR DRIVING THE SAME, DISPLAY PANEL, AND DISPLAY DEVICE

This application is a US National Stage of International Application No. PCT/CN2017/103036, filed on Sep. 22, 2017, designating the United States and claiming priority to Chinese Patent Application No. 201720186107.9, filed with the Chinese Patent Office on Feb. 28, 2017 and entitled "An inversion control circuit, a display panel, and a display device", the content of which is hereby incorporated by reference in its entirety.

FIELD

The present disclosure relates to the field of display technologies, and particularly to an inversion control circuit, a method for driving the same, a display panel, and a display device.

BACKGROUND

With the rapid development of display technologies, display panels are being developed toward high integration and a low cost thereof. Particularly in the Gate Driver On Array (GOA) technology, a Thin Film Transistor (TFT) gate driver circuit is integrated on an array substrate of a display panel to form scan driving of the display panel, so that a wiring space for a bonding area and a fan-out area of a gate Integrated Circuit (IC) can be dispensed with, thus lowering product costs in materials and a manufacturing process, and also making the display panel in an appearance-pleasing design with two symmetric sides and a narrow edge frame.

In the related art, the gate driver circuit in the GOA technology needs to be driven using a clock signal switching between high and low levels at a specific period, and there are an increasing number of required clock signals as the gate driver circuit in the GOA technology is increasingly complex, thus resulting in fluctuating coupled voltage, which may come with abnormal displaying in the display panel, e.g., aging transverse lines, etc.

SUMMARY

In an aspect of the present disclosure, an embodiment of the present disclosure provides an inversion control circuit including: an input circuit, a switching control circuit, a first output circuit, and a second output circuit, wherein: the input circuit is connected respectively with an input signal end, a reference signal end, a first node and a second node, and the input circuit is configured to provide the first node and the second node respectively with a signal of the reference signal end under the control of the input signal end; the switching control circuit is connected respectively with a first switching control signal end, a second switching control signal end, the first node and the second node, and the switching control circuit is configured to provide the first node with a signal of the first switching control signal end under the control of the first switching control signal end, and to provide the second node with a signal of the second switching control signal end under the control of the second switching control signal end; the first output circuit is connected respectively with the input signal end, the reference signal end and an inverted signal output end of the inversion control circuit, and the first output circuit is configured to provide the inverted signal output end with the signal of the reference signal end under the control of the input signal end; and the second output circuit is connected respectively with the first switching control signal end, the second switching control signal end, the first node, the second node and the inverted signal output end, and the second output circuit is configured to provide the inverted signal output end with the signal of the first switching control signal end under the control of a signal of the first node, and to provide the inverted signal output end with the signal of the second switching control signal end under the control of a signal of the second node.

In some embodiments, the switching control circuit includes a first switch transistor and a second switch transistor, wherein: the first switch transistor has both a control electrode and a first electrode connected with the first switching control signal end, and a second electrode connected with the first node; and the second switch transistor has both a control electrode and a first electrode connected with the second switching control signal end, and a second electrode connected with the second node.

In some embodiments, the input circuit includes a third switch transistor and a fourth switch transistor, wherein: the third switch transistor has a control electrode connected with the input signal end, a first electrode connected with the reference signal end, and a second electrode connected with the first node; and the fourth switch transistor has a control electrode connected with the input signal end, a first electrode connected with the reference signal end, and a second electrode connected with the second node.

In some embodiments, the first output circuit includes a fifth switch transistor, wherein: the fifth switch transistor has a control electrode connected with the input signal end, a first electrode connected with the reference signal end, and a second electrode connected with the inverted signal output end.

In some embodiments, the second output circuit includes a sixth switch transistor and a seventh switch transistor, wherein: the sixth switch transistor has a control electrode connected with the first node, a first electrode connected with the first switching control signal end, and a second electrode connected with the inverted signal output end; and the seventh switch transistor has a control electrode connected with the second node, a first electrode connected with the second switching control signal end, and a second electrode connected with the inverted signal output end.

An embodiment of the present disclosure further provides a method for driving the inversion control circuit above, the method including: in the first stage, providing, by the input circuit, the first node and the second node respectively with the signal of the reference signal end under the control of the input signal end; and providing, by the first output circuit, the inverted signal output end with the signal of the reference signal end under the control of the input signal end; and in the second stage, providing, by the switching control circuit, the first node with the signal of the first switching control signal end under the control of the first switching control signal end; and providing, by the second output circuit, the inverted signal output end with the signal of the first switching control signal end under the control of the signal of the first node; or in the second stage, providing, by the switching control circuit, the second node with the signal of the second switching control signal end under the control of the second switching control signal end; and providing, by the second output circuit, the inverted signal output end with the signal of the second switching control signal end under the control of the signal of the second node.

In another aspect of the present disclosure, an embodiment of the present disclosure further provides another inversion control circuit including: an input circuit, a switching control circuit, a first output circuit, and a second output circuit, wherein: the input circuit is connected respectively with an input signal end, a reference signal end and a first node, and the input circuit is configured to provide the first node respectively with a signal of the reference signal end under the control of the input signal end; the switching control circuit is connected respectively with a switching control signal end and the first node, and the switching control circuit is configured to provide the first node with a signal of the switching control signal end under the control of the switching control signal end; the first output circuit is connected respectively with the input signal end, the reference signal end, and an inverted signal output end of the inversion control circuit, and the first output circuit is configured to provide the inverted signal output end with the signal of the reference signal end under the control of the input signal end; and the second output circuit is connected respectively with the switching control signal end, the first node and the inverted signal output end, and the second output circuit is configured to provide the inverted signal output end with the signal of the switching control signal end under the control of a signal of the first node.

In some embodiments, the switching control circuit includes a first switch transistor, wherein: the first switch transistor has both a control electrode and a first electrode connected with the switching control signal end, and a second electrode connected with the first node.

In some embodiments, the input circuit includes a second switch transistor, wherein: the second switch transistor has a control electrode connected with the input signal end, a first electrode connected with the reference signal end, and a second electrode connected with the first node.

In some embodiments, the first output circuit includes a third switch transistor, wherein: the third switch transistor has a control electrode connected with the input signal end, a first electrode connected with the reference signal end, and a second electrode connected with the inverted signal output end.

In some embodiments, the second output circuit includes a fourth switch transistor, wherein: the fourth switch transistor has a control electrode connected with the first node, a first electrode connected with the switching control signal end, and a second electrode connected with the inverted signal output end.

An embodiment of the present disclosure further provides a method for driving the inversion control circuit above, the method including: in the first stage, providing, by the input circuit, the first node with the signal of the reference signal end under the control of the input signal end; and providing, by the first output circuit, the inverted signal output end with the signal of the reference signal end under the control of the input signal end; and in the second stage, providing, by the switching control circuit, the first node with the signal of the switching control signal end under the control of the switching control signal end; and providing, by the second output circuit, the inverted signal output end with the signal of the switching control signal end under the control of the signal of the first node.

In still another aspect of the present disclosure, an embodiment of the present disclosure further provides a display panel including at least one clock signal line, wherein the display panel further includes: inverted clock signal lines corresponding to the respective clock signal lines in a one-to-one manner, and the inversion control circuits according to any one of the embodiments above of the present disclosure corresponding to the respective clock signal lines in a one-to-one manner; and the inversion control circuits have their input signal ends connected with their corresponding clock signal lines, and their inverted signal output ends connected with their corresponding inverted clock signal lines.

Optionally the display panel includes at most three clock signal lines.

Optionally the display panel includes three clock signal lines.

Optionally the respective clock signal lines, the respective inverted clock signal lines, and the respective inversion control circuits are located in a non-display area of the display panel.

In a further aspect of the present disclosure, an embodiment of the present disclosure further provides a display device including the display panel according to any one of the embodiments above of the present disclosure.

DETAILED DESCRIPTION OF THE EMBODIMENTS

In order to make the objects, technical solutions, and advantages of the present disclosure more apparent, particular implementations of an inversion control circuit, a method for driving the same, a display panel, and a display device according to the embodiments of the present disclosure will be described below in details with reference to the drawings. It shall be appreciated that the embodiments to be described below are merely intended to illustrate and explain the present disclosure, but not to limit the present disclosure thereto. Moreover the embodiments of the present disclosure and the features in the embodiments can be combined with each other unless they conflict with each other.

Figure 1:
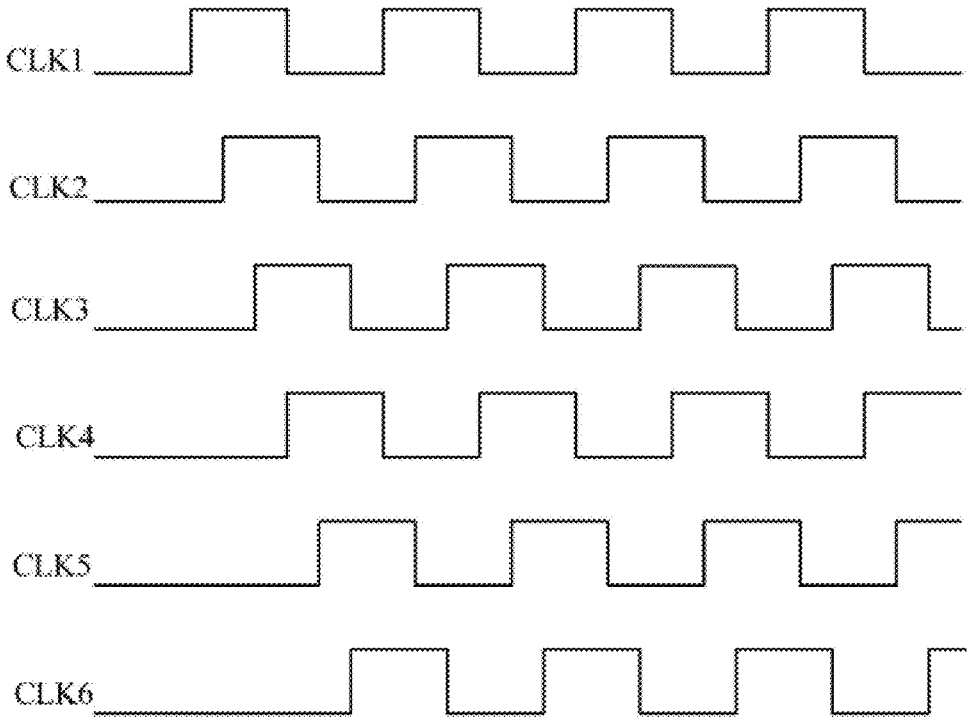
FIG. 1 is a schematic diagram of a GOA gate driver circuit using six clock signals in the related art.

In the related art, in the gate driver circuit of GOA, as illustrated in FIG. 1, taking six clock signals input to the gate driver circuit as an example, after a frame of display image is scanned, the clock signal CLK4 is an inverted signal of the clock signal CLK1, the clock signal CLK5 is an inverted signal of the clock signal CLK2, and the clock signal CLK6 is an inverted signal of the clock signal CLK3. The respective clock signals are low-level signals before their first high levels, that is, the three pairs of clock signals above are not inverted signals in this period of time, thus resulting in fluctuating coupled voltage, which may come with abnormal displaying in the display panel, e.g., aging transverse lines, etc.

Figure 2:
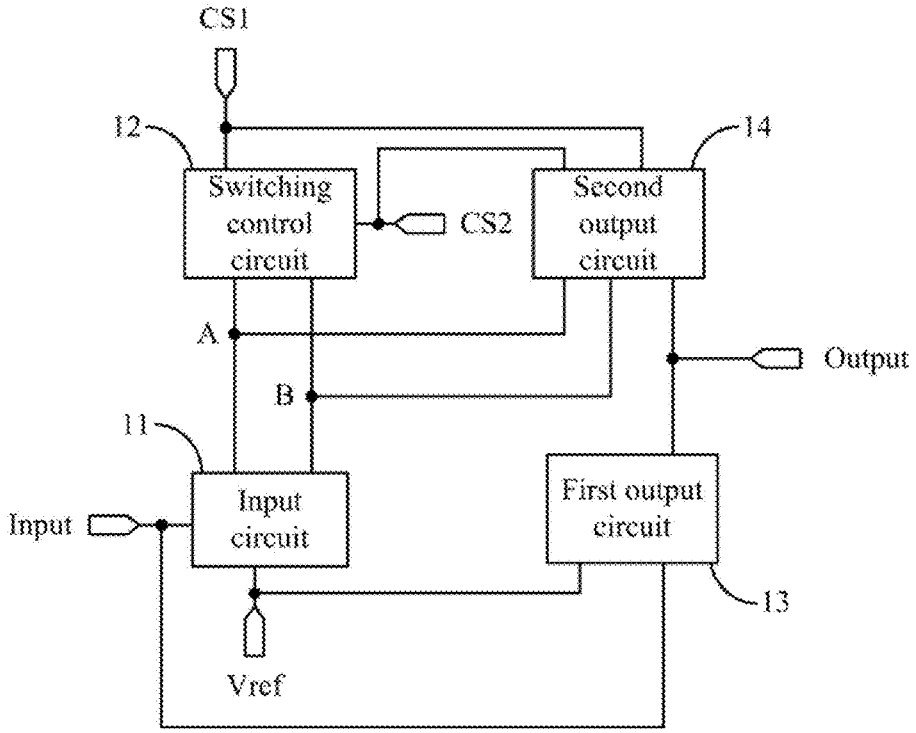
FIG. 2 is a schematic structural diagram of an inversion control circuit according to an embodiment of the present disclosure.

An embodiment of the present disclosure provides an inversion control circuit as illustrated in FIG. 2, which includes an input circuit 11, a switching control circuit 12, a first output circuit 13, and a second output circuit 14.

The input circuit 11 is connected respectively with an input signal end Input, a reference signal end Vref, a first node A and a second node B. The input circuit 11 is configured to provide the first node A and the second node B respectively with a signal of the reference signal end Vref under the control of the input signal end Input.

The switching control circuit 12 is connected respectively with a first switching control signal end CS1, a second switching control signal end CS2, the first node A and the second node B. The switching control circuit 12 is configured to provide the first node A with a signal of the first switching control signal end CS1 under the control of the first switching control signal end CS1, and to provide the second node B with a signal of the second switching control signal end CS2 under the control of the second switching control signal end CS2.

The first output circuit 13 is connected respectively with the input signal end Input, the reference signal end Vref and an inverted signal output end Output of the inversion control circuit. The first output circuit 13 is configured to provide the inverted signal output end Output with the signal of the reference signal end Vref under the control of the input signal end Input.

The second output circuit 14 is connected respectively with the first switching control signal end CS1, the second switching control signal end CS2, the first node A, the second node B and the inverted signal output end Output. The second output circuit 14 is configured a signal of the first node A to provide the inverted signal output end Output with the signal of the first switching control signal end CS1 under the control of, and to provide the inverted signal output end Output with the signal of the second switching control signal end CS2 under the control of a signal of the second node B.

In the inversion control circuit according to the embodiment of the present disclosure, the four circuits above cooperate with each other to thereby enable the potential of the input signal end Input to be opposite, e.g., totally or substantially opposite, to the potential of the inverted signal output end Output, so that when the inversion control circuit is applicable to a display panel, a clock signal is used as an input signal, and an output signal is a clock signal opposite in phase.

In the inversion control circuit according to some embodiment of the present disclosure, when the potential of a valid pulse signal of the input signal end Input is a high potential, the potential of the reference signal end Vref is a low potential; and when the potential of the valid pulse signal of the input signal end Input is a low potential, the potential of the reference signal end Vref is a high potential.

In the inversion control circuit according to some embodiment of the present disclosure, the potential of the first switching control signal end CS1 is an opposite potential in each adjacent preset interval length of time; and the potential of the first switching control signal end CS1 and the potential of the second switching control signal end CS2 are opposite potentials; where the preset interval length of time is a period of time in which N frames are displayed, and N is an integer more than or equal to 1.

For example, the potential of the first switching control signal end CS1 is a high potential (or a low potential), and the potential of the second switching control signal end CS2 is a low potential (or a high potential), in the current preset interval length of time; the potential of the first switching control signal end CS1 is a low potential (or a high potential), and the potential of the second switching control signal end CS2 is a high potential (or a low potential), in a next preset interval length of time; and the potentials of the first switching control signal end CS1 and the second switching control signal end CS2 are repeated as in the current preset interval length of time and the next preset interval length of time, after the next preset interval length of time until the displaying is stopped, where the preset interval length of time is a period of time in which N frames are displayed, and N is an integer more than or equal to 1. In a real application, the preset interval length of time can for example be 2 to 4 seconds, and of course, the particular period of time of the preset interval length of time will not be limited thereto but shall be determined as needed in a real application scenario.

Figure 3A:
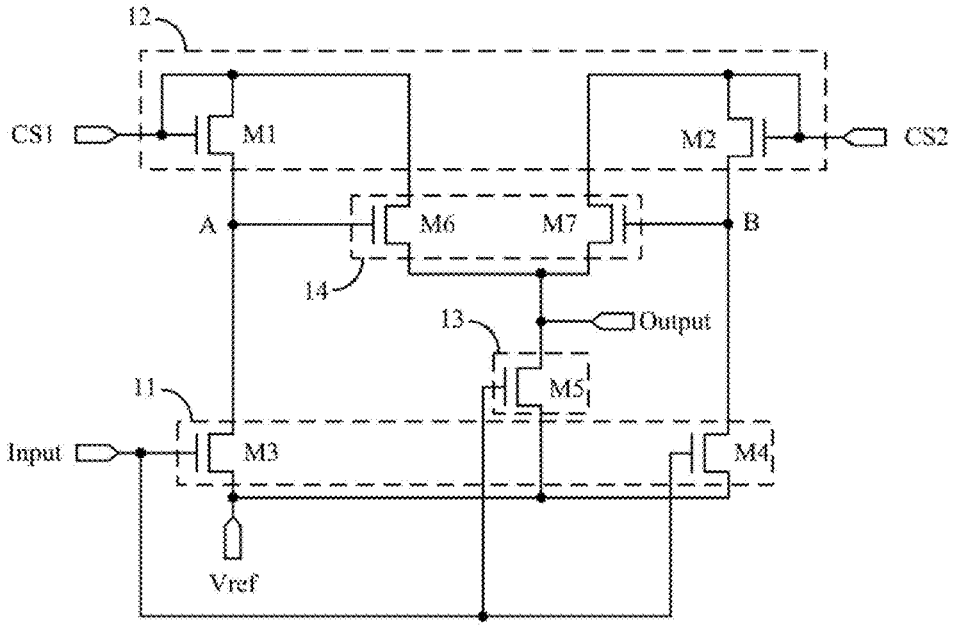
FIG. 3*a* is a first schematic structural diagram of the inversion control circuit illustrated in FIG. 2.
Figure 3B:
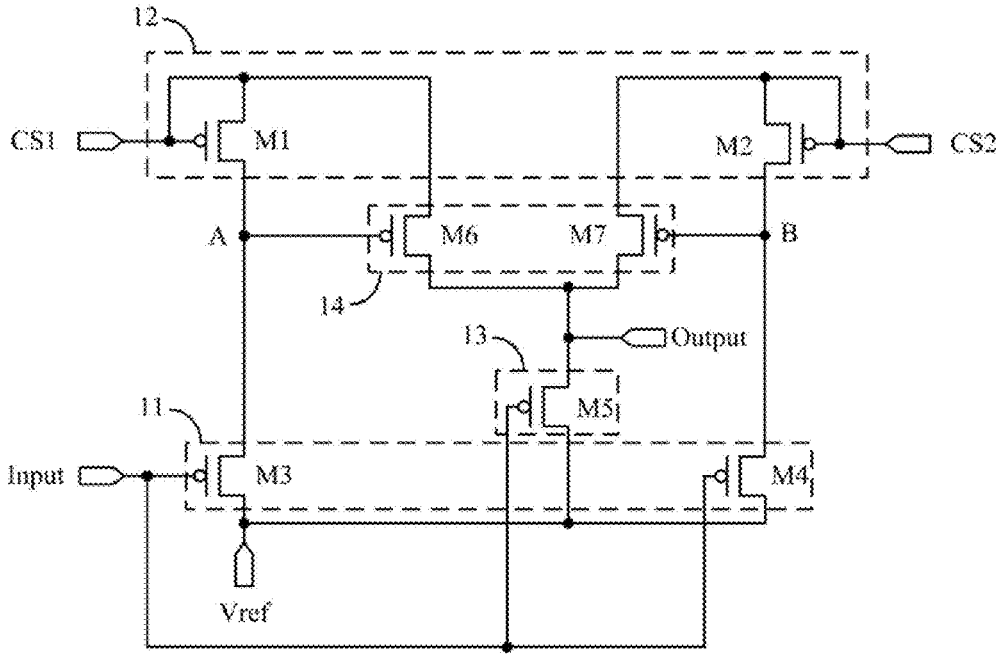
FIG. 3*b* is a second schematic structural diagram of the inversion control circuit illustrated in FIG. 2.

In the inversion control circuit according to some embodiment of the present disclosure, as illustrated in FIG. 3*a* and FIG. 3*b*, the input circuit 11 can include a third switch transistor M3 and a fourth switch transistor M4.

The third switch transistor M3 has a control electrode connected with the input signal end Input, a first electrode connected with the reference signal end Vref, and a second electrode connected with the first node A.

The fourth switch transistor M4 has a control electrode connected with the input signal end Input, a first electrode connected with the reference signal end Vref, and a second electrode connected with the second node B.

In the inversion control circuit according to some embodiment of the present disclosure, the third switch transistor M3 and the fourth switch transistor M4 can be N-type transistors as illustrated in FIG. 3*a*. At this time, when a valid pulse signal of the input signal end Input is at a high potential, the third switch transistor M3 is switched on and provides the first node A with the low potential of the reference signal end Vref. When the valid pulse signal of the input signal end Input is a high potential, the fourth switch transistor M4 is switched on and provides the second node B with the low potential of the reference signal end Vref.

In the inversion control circuit according to some embodiment of the present disclosure, the third switch transistor M3 and the fourth switch transistor M4 can be P-type transistors as illustrated in FIG. 3*b*. At this time, when a valid pulse signal of the input signal end Input is at a low potential, the third switch transistor M3 is switched on and provides the first node A with the high potential of the reference signal end Vref. When the valid pulse signal of the input signal end Input is a low potential, the fourth switch transistor M4 is switched on and provides the second node B with the high potential of the reference signal end Vref.

In the inversion control circuit according to some embodiment of the present disclosure, as illustrated in FIG. 3*a* and FIG. 3*b*, the switching control circuit 12 can include a first switch transistor M1 and a second switch transistor M2.

The first switch transistor M1 has both a control electrode and a first electrode connected with the first switching control signal end CS1, and a second electrode connected with the first node A.

The second switch transistor M2 has both a control electrode and a first electrode connected with the second switching control signal end CS2, and a second electrode connected with the second node B.

In the inversion control circuit according to some embodiment of the present disclosure, the first switch transistor M1 and the second switch transistor M2 can be N-type transistors as illustrated in FIG. 3*a*. At this time, when the first switching control signal end CS1 is at a high potential, the first switch transistor M1 is switched on and provides the first node A with the high potential of the first switching control signal end CS1. When the second switching control signal end CS2 is at a high potential, the second switch transistor M2 is switched on and provides the second node B with the high potential of the second switching control signal end CS2.

In the inversion control circuit according to some embodiment of the present disclosure, the first switch transistor M1 and the second switch transistor M2 can be P-type transistors as illustrated in FIG. 3*b*. At this time, when the first switching control signal end CS1 is at a low potential, the first switch transistor M1 is switched on and provides the first node A with the low potential of the first switching control signal end CS1. When the second switching control signal end CS2 is at a low potential, the second switch transistor M2 is switched on and provides the second node B with the low potential of the second switching control signal end CS2.

Since the potential of the first switching control signal end CS1 and the potential of the second switching control signal end CS2 are periodically alternately high potentials (or low potentials), the first switch transistor M1 and the second switch transistor M2 are switched alternately instead of being stressed all the time, to thereby alleviate the electrical performance of the first switch transistor M1 and the second switch transistor M2 from being affected by their stresses so as to improve their reliabilities.

In the inversion control circuit according to some embodiment of the present disclosure, the width to length ratio of a channel of the third switch transistor M3 is set in a fabrication process to be larger than the width to length ratio of a channel of the first switch transistor M1, so that when there is a valid pulse signal of the input signal end Input, the third switch transistor M3 provides the first node A with the signal of the reference signal end Vref under the control of the input signal end Input at a higher rate than a rate at which the first switch transistor M1 provides the first node A with the signal of the first switching control signal end CS1 under the control of the first switching control signal end CS1, thus enabling the potential of the first node A to be opposite to the potential of the input signal end Input when there is the valid pulse signal of the input signal end Input.

In the inversion control circuit according to some embodiment of the present disclosure, the width to length ratio of a channel of the fourth switch transistor M4 is set in a fabrication process to be larger than the width to length ratio of a channel of the second switch transistor M2, so that when there is a valid pulse signal of the input signal end Input, the fourth switch transistor M4 provides the second node B with the signal of the reference signal end Vref under the control of the input signal end Input at a higher rate than a rate at which the second switch transistor M2 provides the second node B with the signal of the second switching control signal end CS2 under the control of the second switching control signal end CS2, thus enabling the potential of the second node B to be opposite to the potential of the input signal end Input when there is the valid pulse signal of the input signal end Input.

In the inversion control circuit according to some embodiment of the present disclosure, the width to length ratio of the channel of the first switch transistor M1 and the width to length ratio of the channel of the third switch transistor M3 can satisfy a 1:2 relationship, and the width to length ratio of the channel of the second switch transistor M2 and the width to length ratio of the channel of the fourth switch transistor M4 can satisfy a 1:2 relationship. Of course, the width to length ratio of the channel of the first switch transistor M1 and the width to length ratio of the channel of the third switch transistor M3 can alternatively satisfy another proportional relationship, and the width to length ratio of the channel of the second switch transistor M2 and the width to length ratio of the channel of the fourth switch transistor M4 can alternatively satisfy another proportional relationship, although the embodiment of the present disclosure will not be limited thereto.

In the inversion control circuit according to some embodiment of the present disclosure, as illustrated in FIG. 3*a* and FIG. 3*b*, the first output circuit 13 can include a fifth switch transistor M5.

The fifth switch transistor M5 has a control electrode connected with the input signal end Input, a first electrode connected with the reference signal end Vref, and a second electrode connected with the inverted signal output end Output.

In the inversion control circuit according to some embodiment of the present disclosure, the fifth switch transistor M5 can be an N-type transistor as illustrated in FIG. 3*a*. At this time, when the valid pulse signal of the input signal end Input is at a high potential, the fifth switch transistor M5 is switched on and provides the inverted signal output end Output with the low potential of the reference signal end Vref.

In the inversion control circuit according to some embodiment of the present disclosure, the fifth switch transistor M5 can be a P-type transistor as illustrated in FIG. 3*b*. At this time, when the valid pulse signal of the input signal end Input is at a low potential, the fifth switch transistor M5 is switched on and provides the inverted signal output end Output with the high potential of the reference signal end Vref.

In the inversion control circuit according to some embodiment of the present disclosure, as illustrated in FIG. 3*a* and FIG. 3*b*, the second output circuit 14 can include a sixth switch transistor M6 and a seventh switch transistor M7.

The sixth switch transistor M6 has a control electrode connected with the first node A, a first electrode connected with the first switching control signal end CS1, and a second electrode connected with the inverted signal output end Output.

The seventh switch transistor M7 has a control electrode connected with the second node B, a first electrode connected with the second switching control signal end CS2, and a second electrode connected with the inverted signal output end Output.

In the inversion control circuit according to some embodiment of the present disclosure, the sixth switch transistor M6 and the seventh switch transistor M7 can be N-type transistors as illustrated in FIG. 3*a*. At this time, when the first node A is at a high potential, the sixth switch transistor M6 is switched on and provides the inverted signal output end Output with the signal of the first switching control signal end CS1. When the second node B is at a high potential, the seventh switch transistor M7 is switched on and provides the inverted signal output end Output with the signal of the second switching control signal end CS2.

In the inversion control circuit according to some embodiment of the present disclosure, the sixth switch transistor M6 and the seventh switch transistor M7 can be P-type transistors as illustrated in FIG. 3*b*. At this time, when the first node A is at a low potential, the sixth switch transistor M6 is switched on and provides the inverted signal output end Output with the signal of the first switching control signal end CS1. When the second node B is at a low potential, the seventh switch transistor M7 is switched on and provides the inverted signal output end Output with the signal of the second switching control signal end CS2.

In the inversion control circuit according to some embodiment of the present disclosure, the width to length ratio of a channel of the fifth switch transistor M5 is set in a fabrication process to be larger than the width to length ratio of a channel of the sixth switch transistor M6, so that when there is a valid pulse signal of the input signal end Input, the fifth switch transistor M5 provides the inverted signal output end Output with the signal of the reference signal end Vref under the control of the input signal end Input at a higher rate than a rate at which the sixth switch transistor M6 provides the inverted signal output end Output with the signal of the first switching control signal end CS1 under the control of the first node A, thus enabling the potential of the inverted signal output end Output to be opposite to the potential of the input signal end Input when there is the valid pulse signal of the input signal end Input.

In the inversion control circuit according to some embodiment of the present disclosure, the width to length ratio of a channel of the fifth switch transistor M5 is set in a fabrication process to be larger than the width to length ratio of a channel of the seventh switch transistor M7, so that when there is a valid pulse signal of the input signal end Input, the fifth switch transistor M5 provides the inverted signal output end Output with the signal of the reference signal end Vref under the control of the input signal end Input at a higher rate than a rate at which the seventh switch transistor M7 provides the inverted signal output end Output with the signal of the second switching control signal end CS2 under the control of the second node B, thus enabling the potential of the inverted signal output end Output to be opposite to the potential of the input signal end Input when there is the valid pulse signal of the input signal end Input.

In the inversion control circuit according to some embodiment of the present disclosure, the width to length ratio of the channel of the sixth switch transistor M6 and the width to length ratio of the channel of the fifth switch transistor M5 can satisfy a 1:6 relationship, and the width to length ratio of the channel of the seventh switch transistor M7 and the width to length ratio of the channel of the fifth switch transistor M5 can satisfy a 1:6 relationship. Of course, the width to length ratio of the channel of the sixth switch transistor M6 and the width to length ratio of the channel of the fifth switch transistor M5 can alternatively satisfy another proportional relationship, and the width to length ratio of the channel of the seventh switch transistor M7 and the width to length ratio of the channel of the fifth switch transistor M5 can alternatively satisfy another proportional relationship, although the embodiment of the present disclosure will not be limited thereto.

The particular structures of the respective circuits in the inversion control circuit according to the embodiments of the present disclosure have only been described above by way of an example, and will not be limited to the structures above according to the embodiments of the present disclosure, but can alternatively be other structures known to those skilled in the art, although the embodiments of the present disclosure will not be limited thereto.

In the inversion control circuit according to some embodiment of the present disclosure, all the switch transistors are typically switch transistors made of the same material. As illustrated in FIG. 3*a*, for example, all the switch transistors can be N-type transistors, where an N-type transistor is switched on at a high potential and switched off at a low potential, and at this time, the potential of a valid pulse signal of the input signal end Input is a high potential. Alternatively as illustrated in FIG. 3*b*, all the switch transistors can be P-type transistors, where a P-type transistor is switched off at a high potential and switched on at a low potential, and at this time, the potential of a valid pulse signal of the input signal end Input is a low potential, although the embodiment of the present disclosure will not be limited thereto.

The switch transistors as referred to in the embodiments above of the present disclosure can be Thin Film Transistors (TFTs), or can be Metal Oxide Semiconductor Field Effect Transistors (MOSFETs), although the embodiment of the present disclosure will not be limited thereto. Furthermore the control electrodes of these switch transistors are gates, and their first electrodes can be sources or drains of the switch transistors while their second electrodes can be the drains or the sources of the switch transistors, dependent upon different types of the switch transistors, and different signals of the signal ends, although the embodiment of the present disclosure will not be limited thereto.

Taking the structure of the inversion control circuit illustrated in FIG. 3*a* as an example, an operating process of the inversion control circuit according to the embodiment of the present disclosure will be described below with reference to a timing diagram of the circuit, where the preset interval length of time is a period of time for displaying one frame, for example. In the following description, 1 represents a high-potential signal, and 0 represents a low-potential signal, where 1 and 0 representing their logic potentials are merely intended to better explain the operating process of the inversion control circuit according to the embodiment of this discourse, but not to suggest potentials applied to the control electrodes of the respective switch transistors in a particular implementation.

Figure 6A:
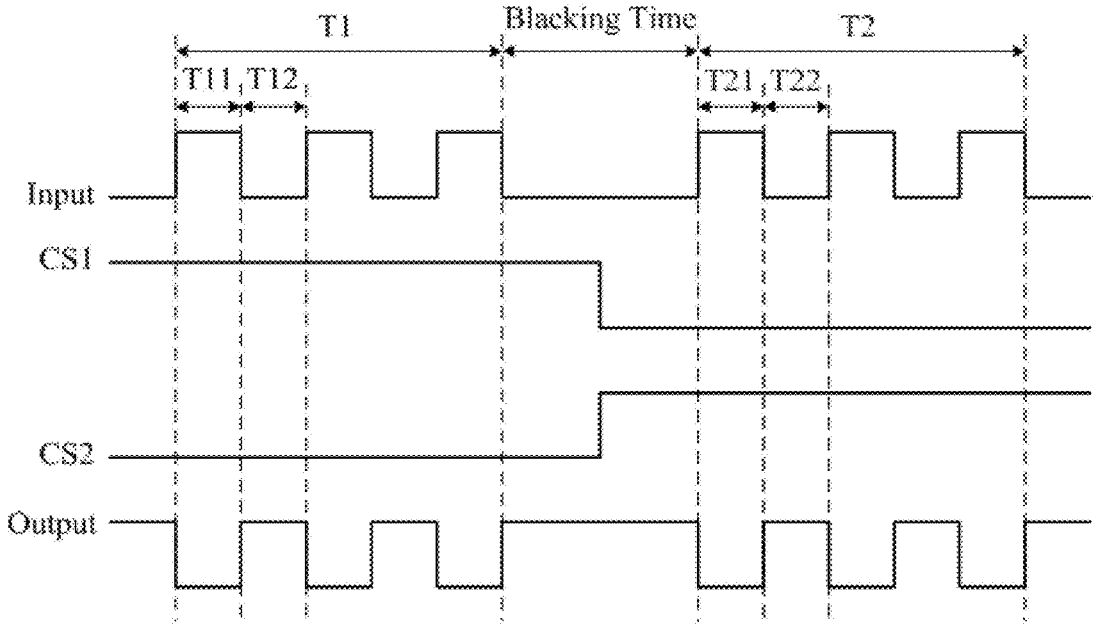
FIG. 6*a* is a timing diagram of the inversion control circuit illustrated in FIG. 3*a;*

In some embodiments, all the switch transistors in the inversion control circuit are N-type transistors as illustrated in FIG. 3*a*; and FIG. 6*a* illustrates a corresponding input-output timing diagram thereof. Particularly in the input-output timing diagram illustrated in FIG. 6*a*, there are two selected stages T11 and T12 in a period of time T1 for displaying a frame, where CS1=1, and CS2=0; and two selected stages T21 and T22 in a next period of time T2 for displaying a frame, where CS1=0, and CS2=1.

In the T11 stage, Input=1, CS1=1, and CS2=0.

With Input=1, all of the third switch transistor M3, the fourth switch transistor M4, and the fifth switch transistor M5 are switched on. With CS1=1, the first switch transistor M1 is switched on and provides the first node A with the signal of the first switching control signal end CS1 at a high potential; and the third switch transistor M3 is switched on and provides the first node A with the signal of the reference signal end Vref at a low potential, and the width to length ratio of the channel of the third switch transistor M3 is larger than the width to length ratio of the channel of the first switch transistor M1, so the potential of the first node A is a low potential. Since the potential of the first node A is a low potential, the sixth switch transistor M6 is switched off. Since the fourth switch transistor M4 is switched on and provides the second node B with the signal of the reference signal end Vref at a low potential, the potential of the second node B is a low potential. Since the potential of the second node B is a low potential, the seventh switch transistor M7 is switched off. Since the fifth switch transistor M5 is switched on and provides the inverted signal output end Output with the signal of the reference signal end Vref at a low potential, a signal at a low potential is output from the inverted signal output end Output, that is, opposite in potential to the input signal end Input. With CS2=0, the second switch transistor M2 is switched off.

In the T12 stage, Input=0, CS1=1, and CS2=0.

With Input=0, all of the third switch transistor M3, the fourth switch transistor M4, and the fifth switch transistor M5 are switched off. With CS1=1, the first switch transistor M1 is switched on and provides the first node A with the signal of the first switching control signal end CS1 at a high potential, so the first node A is at a high potential. Since the first node A is at a high potential, the sixth switch transistor M6 is switched on and provides the inverted signal output end Output with the signal of the first switching control signal end CS1 at a high potential, a signal at a high potential is output from the inverted signal output end Output, that is, opposite in potential to the input signal end Input. With CS2=0, the second switch transistor M2 is switched off. The potential of the second node B is kept at a low potential, so the seventh switch transistor M7 is kept switched off.

After the T12 stage, the operating process in the T11 and T12 stages are repeated until the next period of time for displaying a frame starts.

In the T21 stage, Input=1, CS1=0, and CS2=1.

With Input=1, all of the third switch transistor M3, the fourth switch transistor M4, and the fifth switch transistor M5 are switched on. Since the third switch transistor M3 is switched on and provides the first node A with the signal of the reference signal end Vref at a low potential, the potential of the first node A is a low potential. Since the potential of the first node A is a low potential, the sixth switch transistor M6 is switched off. With CS2=1, the second switch transistor M2 is switched on and provides the second node B with the signal of the second switching control signal end CS2 at a high potential; and the fourth switch transistor M4 is switched on and provides the second node B with the signal of the reference signal end Vref at a low potential, and the width to length ratio of the channel of the fourth switch transistor M4 is larger than the width to length ratio of the channel of the second switch transistor M2, so the potential of the second node B is a low potential. Since the potential of the second node B is a low potential, the seventh switch transistor M7 is switched off. Since the fifth switch transistor M5 is switched on and provides the inverted signal output end Output with the signal of the reference signal end Vref at a low potential, a signal at a low potential is output from the inverted signal output end Output, that is, opposite in potential to the input signal end Input. With CS1=0, the first switch transistor M1 is switched off.

In the T22 stage, Input=0, CS1=0, and CS2=1.

With Input=0, all of the third switch transistor M3, the fourth switch transistor M4, and the fifth switch transistor M5 are switched off. With CS2=1, the second switch transistor M2 is switched on and provides the second node B with the signal of the second switching control signal end CS2 at a high potential, so the second node B is at a high potential. Since the second node B is at a high potential, the seventh switch transistor M7 is switched on and provides the inverted signal output end Output with the signal of the second switching control signal end CS2 at a high potential, a signal at a high potential is output from the inverted signal output end Output, that is, opposite in potential to the input signal end Input. With CS1=0, the first switch transistor M1 is switched off. The potential of the first node A is kept at a low potential, so the sixth switch transistor M6 is kept switched off.

After the T22 stage, the operating process in the T21 and T22 stages are repeated until the next period of time for displaying a frame starts.

As illustrated in FIG. 6*a*, a blacking time is typically arranged between adjacent frames to be displayed, so both the potential of the first switching control signal end CS1 and the potential of the second switching control signal end CS2 can be switched in the blacking time period.

In the inversion control circuit according to the embodiment of the present disclosure, the voltage of the inverted signal output end Output can be made opposite, e.g., totally or substantially opposite, to the potential of the input signal end Input simply using the plurality of switch transistors. Compared with the related art in which the inversion control circuit is consisted of the capacitors and the transistors, the switch transistors occupy a smaller space than a space occupied by the capacitors, and for example, the three switch transistors in the embodiment of the present disclosure occupy a smaller space than a space occupied by the two capacitors in the related art, so the area of the occupied space can be narrowed, thus facilitating the design of a narrow edge frame for the display panel to which the embodiment of the present disclosure is applied.

Figure 7:
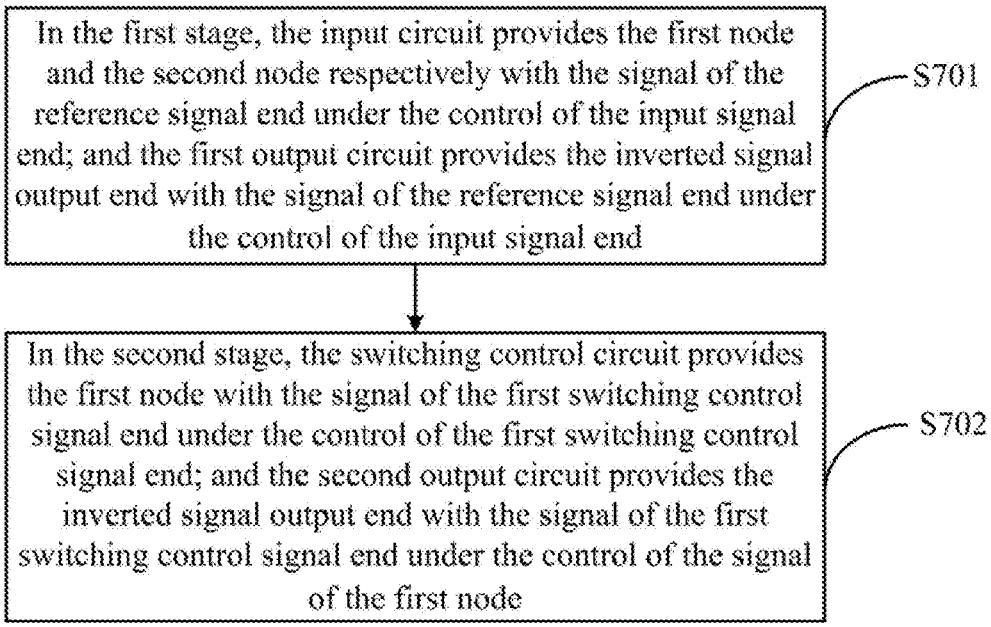
FIG. 7 is a first flow chart of a method for driving the inversion control circuit illustrated in FIG. 2.

An embodiment of the present disclosure further provides a method for driving the inversion control circuit above according to the embodiment of the present disclosure, and as illustrated in FIG. 7, the method includes a first stage and a second stage.

In the step S701, in the first stage, the input circuit provides the first node and the second node respectively with the signal of the reference signal end under the control of the input signal end; and the first output circuit provides the inverted signal output end with the signal of the reference signal end under the control of the input signal end.

In the step S702, in the second stage, the switching control circuit provides the first node with the signal of the first switching control signal end under the control of the first switching control signal end; and the second output circuit provides the inverted signal output end with the signal of the first switching control signal end under the control of the signal of the first node.

Figure 8:
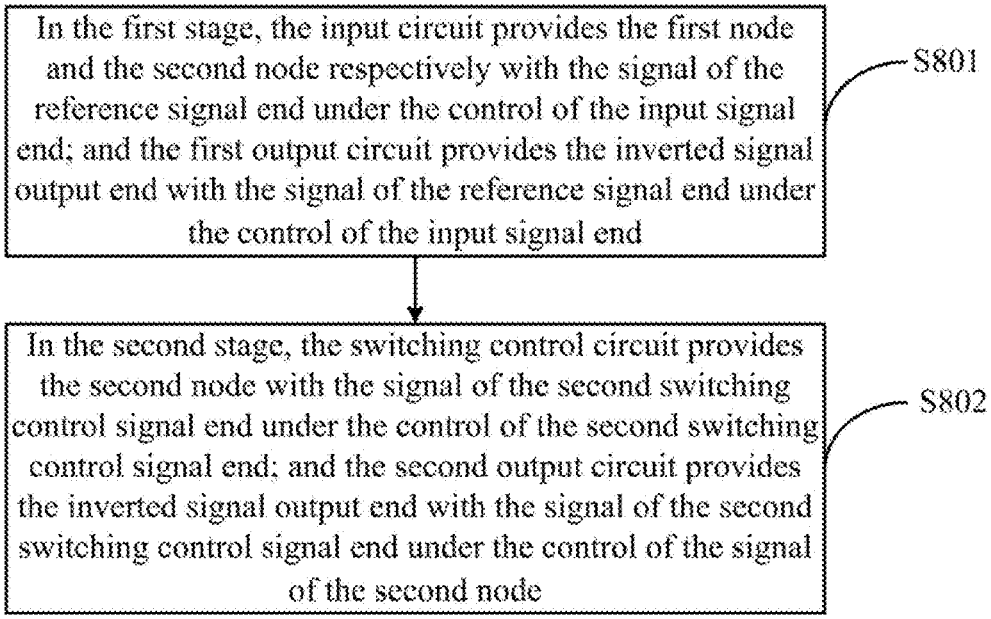
FIG. 8 is a second flow chart of a method for driving the inversion control circuit illustrated in FIG. 2.

Alternatively as illustrated in FIG. 8, the method includes a first stage and a second stage.

In the step S801, in the first stage, the input circuit provides the first node and the second node respectively with the signal of the reference signal end under the control of the input signal end; and the first output circuit provides the inverted signal output end with the signal of the reference signal end under the control of the input signal end.

In the step S802, in the second stage, the switching control circuit provides the second node with the signal of the second switching control signal end under the control of the second switching control signal end; and the second output circuit provides the inverted signal output end with the signal of the second switching control signal end under the control of the signal of the second node.

Figure 4:
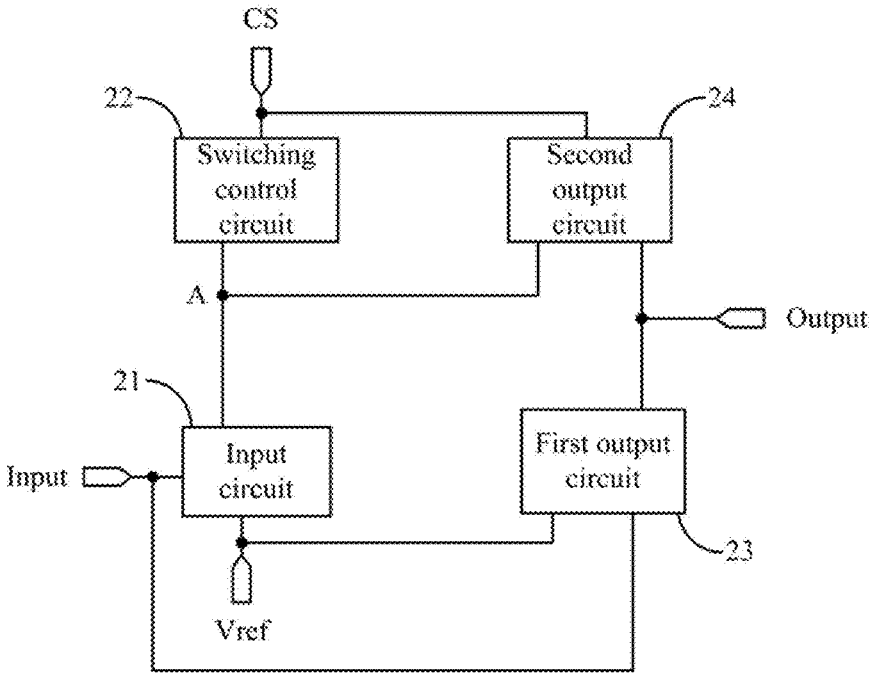
FIG. 4 is another schematic structural diagram of an inversion control circuit according to an embodiment of the present disclosure.

An embodiment of the present disclosure further provides another inversion control circuit as illustrated in FIG. 4, which includes an input circuit 21, a switching control circuit 22, a first output circuit 23, and a second output circuit 24.

The input circuit 21 is connected respectively with an input signal end Input, a reference signal end Vref, and a first node A. The input circuit 21 is configured to provide the first node A with a signal of the reference signal end Vref under the control of the input signal end Input.

The switching control circuit 22 is connected respectively with a switching control signal end CS and the first node A. The switching control circuit 22 is configured to provide the first node A with a signal of the switching control signal end CS under the control of the switching control signal end CS.

The first output circuit 23 is connected respectively with the input signal end Input, the reference signal end Vref, and an inverted signal output end Output of the inversion control circuit. The first output circuit 23 is configured to provide the inverted signal output end Output with the signal of the reference signal end Vref under the control of the input signal end Input.

The second output circuit 24 is connected respectively with the switching control signal end, the first node A, and the inverted signal output end Output. The second output circuit 24 is configured to provide the inverted signal output end Output with the signal of the switching control signal end under the control of a signal of the first node A.

In the inversion control circuit according to the embodiment of the present disclosure, the four circuits above cooperate with each other to thereby enable the potential of the input signal end Input to be opposite, e.g., totally or substantially opposite, to the potential of the inverted signal output end Output, so that when the inversion control circuit is applicable to a display panel, a clock signal is used as an input signal, and an output signal is a clock signal opposite in phase.

In the inversion control circuit according to some embodiment of the present disclosure, when the potential of a valid pulse signal of the input signal end Input is a high potential, the potential of the reference signal end Vref is a low potential, and the potential of the switching control signal end CS is a high potential; and when the potential of the valid pulse signal of the input signal end Input is a low potential, the potential of the reference signal end Vref is a high potential, and the potential of the switching control signal end CS is a low potential.

Figure 5A:
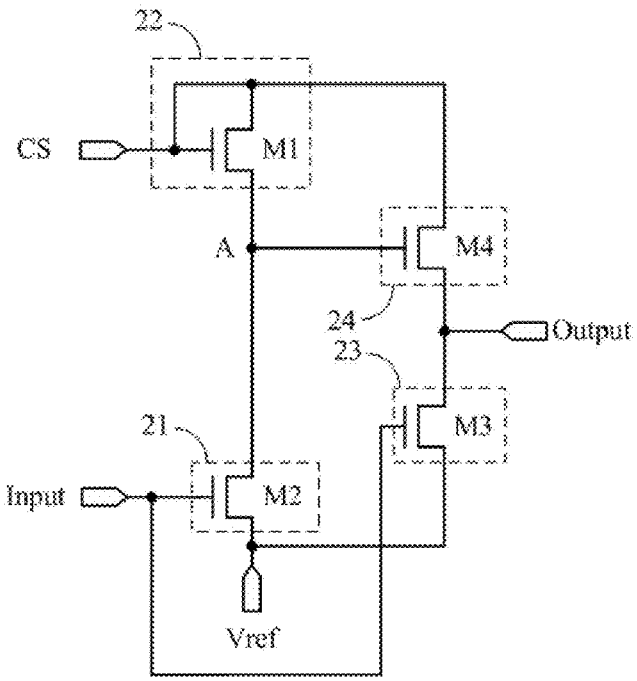
FIG. 5*a* is a first schematic structural diagram of the inversion control circuit illustrated in FIG. 4.
Figure 5B:
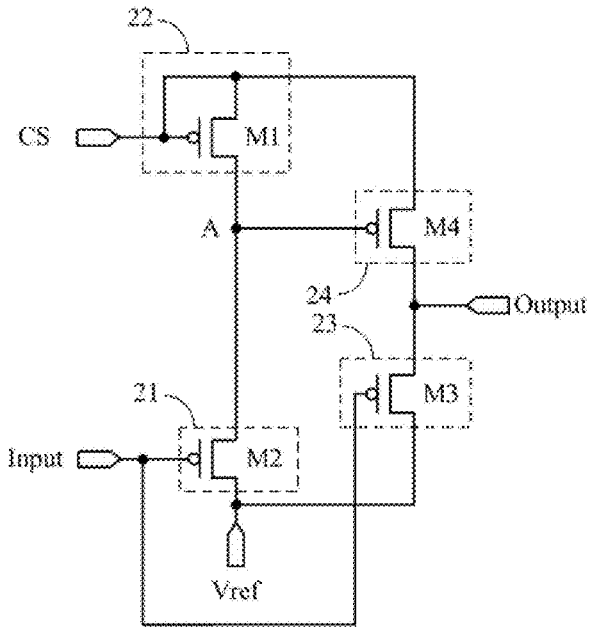
FIG. 5*b* is a second schematic structural diagram of the inversion control circuit illustrated in FIG. 4.

In the inversion control circuit according to some embodiment of the present disclosure, as illustrated in FIG. 5*a* and FIG. 5*b*, the input circuit 21 can include a second switch transistor M2.

The second switch transistor M2 has a control electrode connected with the input signal end Input, a first electrode connected with the reference signal end Vref, and a second electrode connected with the first node A.

In the inversion control circuit according to some embodiment of the present disclosure, the second switch transistor M2 can be an N-type transistor as illustrated in FIG. 5*a*. At this time, when a valid pulse signal of the input signal end Input is at a high potential, the second switch transistor M2 is switched on and provides the first node A with the low potential of the reference signal end Vref.

In the inversion control circuit according to some embodiment of the present disclosure, the second switch transistor M2 can be a P-type transistor as illustrated in FIG. 5*b*. At this time, when a valid pulse signal of the input signal end Input is at a low potential, the second switch transistor M2 is switched on and provides the first node A with the signal of the reference signal end Vref.

In the inversion control circuit according to some embodiment of the present disclosure, as illustrated in FIG. 5*a* and FIG. 5*b*, the switching control circuit 22 can include a first switch transistor M1.

The first switch transistor M1 has both a control electrode and a first electrode connected with the switching control signal end CS, and a second electrode connected with the first node A.

In the inversion control circuit according to some embodiment of the present disclosure, the first switch transistor M1 can be an N-type transistor as illustrated in FIG. 5*a*. At this time, when the switching control signal end CS is at a high potential, the first switch transistor M1 is switched on and provides the first node A with the high potential of the switching control signal end CS.

In the inversion control circuit according to some embodiment of the present disclosure, the first switch transistor M1 can be a P-type transistor as illustrated in FIG. 5*b*. At this time, when the switching control signal end CS is at a low potential, the first switch transistor M1 is switched on and provides the first node A with the high potential of the switching control signal end CS.

In the inversion control circuit according to some embodiment of the present disclosure, the width to length ratio of a channel of the second switch transistor M2 is set in a fabrication process to be larger than the width to length ratio of a channel of the first switch transistor M1, so that when there is a valid pulse signal of the input signal end Input, the second switch transistor M2 provides the first node A with the signal of the reference signal end Vref under the control of the input signal end Input at a higher rate than a rate at which the first switch transistor M1 provides the first node A with the signal of the switching control signal end CS under the control of the switching control signal end CS, thus enabling the potential of the first node A to be opposite to the potential of the input signal end Input when there is the valid pulse signal of the input signal end Input.

In the inversion control circuit according to some embodiment of the present disclosure, the width to length ratio of the channel of the first switch transistor M1 and the width to length ratio of the channel of the second switch transistor M2 can satisfy a 1:2 relationship. Of course, the width to length ratio of the channel of the first switch transistor M1 and the width to length ratio of the channel of the second switch transistor M2 can alternatively satisfy another proportional relationship, although the embodiment of the present disclosure will not be limited thereto.

In the inversion control circuit according to some embodiment of the present disclosure, as illustrated in FIG. 5*a* and FIG. 5*b*, the first output circuit 23 can include a third switch transistor M3.

The third switch transistor M3 has a control electrode connected with the input signal end Input, a first electrode connected with the reference signal end Vref, and a second electrode connected with the inverted signal output end Output.

In the inversion control circuit according to some embodiment of the present disclosure, the third switch transistor M3 can be an N-type transistor as illustrated in FIG. 5*a*. At this time, when the valid pulse signal of the input signal end Input is at a high potential, the third switch transistor M3 is switched on and provides the inverted signal output end Output with the signal of the reference signal end Vref.

In the inversion control circuit according to some embodiment of the present disclosure, the third switch transistor M3 can be a P-type transistor as illustrated in FIG. 3*b*. At this time, when the valid pulse signal of the input signal end Input is at a low potential, the third switch transistor M3 is switched on and provides the inverted signal output end Output with the signal of the reference signal end Vref.

In the inversion control circuit according to some embodiment of the present disclosure, as illustrated in FIG. 5*a* and FIG. 5*b*, the second output circuit 24 can include a fourth switch transistor M4.

The fourth switch transistor M4 has a control electrode connected with the first node A, a first electrode connected with the switching control signal end CS, and a second electrode connected with the inverted signal output end Output.

In the inversion control circuit according to some embodiment of the present disclosure, the fourth switch transistor M4 can be an N-type transistor as illustrated in FIG. 5*a*. At this time, when the first node A is at a high potential, the fourth switch transistor M4 is switched on and provides the inverted signal output end Output with the signal of the switching control signal end CS.

In the inversion control circuit according to some embodiment of the present disclosure, the fourth switch transistor M4 can be a P-type transistor as illustrated in FIG. 5*b*. At this time, when the first node A is at a low potential, the fourth switch transistor M4 is switched on and provides the inverted signal output end Output with the signal of the switching control signal end CS.

In the inversion control circuit according to some embodiment of the present disclosure, the width to length ratio of a channel of the third switch transistor M3 is set in a fabrication process to be larger than the width to length ratio of a channel of the fourth switch transistor M4, so that when there is a valid pulse signal of the input signal end Input, the third switch transistor M3 provides the inverted signal output end Output with the signal of the reference signal end Vref under the control of the input signal end Input at a higher rate than a rate at which the fourth switch transistor M4 provides the inverted signal output end Output with the signal of the switching control signal end CS under the control of the first node A, thus enabling the potential of the inverted signal output end Output to be opposite to the potential of the input signal end Input when there is the valid pulse signal of the input signal end Input.

In the inversion control circuit according to some embodiment of the present disclosure, the width to length ratio of the channel of the fourth switch transistor M4 and the width to length ratio of the channel of the third switch transistor M3 can satisfy a 1:6 relationship. Of course, the width to length ratio of the channel of the sixth switch transistor M4 and the width to length ratio of the channel of the third switch transistor M3 can alternatively satisfy another proportional relationship, although the embodiment of the present disclosure will not be limited thereto.

The particular structures of the respective circuits in the inversion control circuit according to the embodiments of the present disclosure have only been described above by way of an example, and will not be limited to the structures above according to the embodiments of the present disclosure, but can alternatively be other structures known to those skilled in the art, although the embodiments of the present disclosure will not be limited thereto.

In the inversion control circuit according to some embodiment of the present disclosure, all the switch transistors are typically switch transistors made of the same material. As illustrated in FIG. 5*a*, for example, all the switch transistors can be N-type transistors, where an N-type transistor is switched on at a high potential and switched off at a low potential, and at this time, the potential of a valid pulse signal of the input signal end Input is a high potential. Alternatively as illustrated in FIG. 5*b*, all the switch transistors can be P-type transistors, where a P-type transistor is switched off at a high potential and switched on at a low potential, and at this time, the potential of a valid pulse signal of the input signal end Input is a low potential, although the embodiment of the present disclosure will not be limited thereto.

It shall be noted that the switch transistors as referred to in the embodiments of the present disclosure can be Thin Film Transistors (TFTs), or can be Metal Oxide Semiconductor Field Effect Transistors (MOSFETs), although the embodiment of the present disclosure will not be limited thereto. Furthermore the control electrodes of these switch transistors are gates, and their first electrodes can be sources or drains of the switch transistors while their second electrodes can be the drains or the sources of the switch transistors, dependent upon different types of the switch transistors, and different signals of the signal ends, although the embodiment of the present disclosure will not be limited thereto.

Taking the structure of the inversion control circuit illustrated in FIG. 5*a* as an example, an operating process of the inversion control circuit according to the embodiment of the present disclosure will be described below with reference to a timing diagram of the circuit.

Figure 6B:
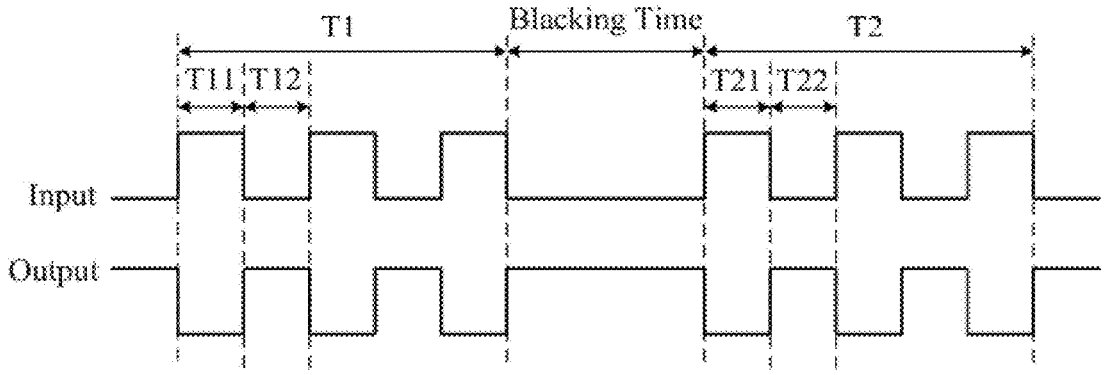
FIG. 6*b* is a timing diagram of the inversion control circuit illustrated in FIG. 5*a;*

All the switch transistors in the inversion control circuit are N-type transistors as illustrated in FIG. 5*a*; and FIG. 6*b* illustrates a corresponding input-output timing diagram thereof. Particularly there are two selected stages T11 and T12 in a period of time T1 for displaying a frame, and two selected stages T21 and T22 in a next period of time T2 for displaying a frame in the input-output timing diagram illustrated in FIG. 6*b*.

In the T11 stage, Input=1, and CS=1.

With Input=1, both the second switch transistor M2 and the third switch transistor M3 are switched on. With CS=1, the first switch transistor M1 is switched on and provides the first node A with the signal of the switching control signal end CS at a high potential; and the second switch transistor M2 is switched on and provides the first node A with the signal of the reference signal end Vref at a low potential, and the width to length ratio of the channel of the second switch transistor M2 is larger than the width to length ratio of the channel of the first switch transistor M1, so the potential of the first node A is a low potential. Since the potential of the first node A is a low potential, the fourth switch transistor M4 is switched off. Since the third switch transistor M3 is switched on and provides the inverted signal output end Output with the signal of the reference signal end Vref at a low potential, a signal at a low potential is output from the inverted signal output end Output, that is, opposite in potential to the input signal end Input.

In the T12 stage, Input=0, and CS=1.

With Input=0, both the second switch transistor M2 and the third switch transistor M3 are switched off. With CS=1, the first switch transistor M1 is switched on and provides the first node A with the signal of the switching control signal end CS at a high potential, so the potential of the first node A is a high potential. Since the potential of the first node A is a high potential, the fourth switch transistor M4 is switched on and provides the inverted signal output end Output with the signal of the switching control signal end CS at a high potential, a signal at a high potential is output from the inverted signal output end Output, that is, opposite in potential to the input signal end Input.

After the T12 stage, the operating process in the T11 and T12 stages are repeated until the next period of time for displaying a frame starts.

In the T21 stage, Input=1, and CS=1. A particular operating process thereof is substantially the same as the operating process in the T11 stage above, so a repeated description thereof will be omitted here.

In the T22 stage, Input=0, and CS=1. A particular operating process thereof is substantially the same as the operating process in the T12 stage above, so a repeated description thereof will be omitted here.

After the T22 stage, the operating process in the T21 and T22 stages are repeated until the next period of time for displaying a frame starts.

As illustrated in FIG. 6*b*, a blacking time is typically arranged between adjacent frames to be displayed.

In the inversion control circuit according to the embodiment of the present disclosure, the voltage of the inverted signal output end Output can be made opposite, e.g., totally or substantially opposite, to the potential of the input signal end Input simply using the plurality of switch transistors. Compared with the related art in which the inversion control circuit is consisted of the capacitors and the transistors, the switch transistors occupy a smaller space than a space occupied by the capacitors, and for example, the three switch transistors in the embodiment of the present disclosure occupy a smaller space than a space occupied by the two capacitors in the related art, so the area of the occupied space can be narrowed, thus facilitating the design of a narrow edge frame for the display panel to which the embodiment of the present disclosure is applied.

Figure 9:
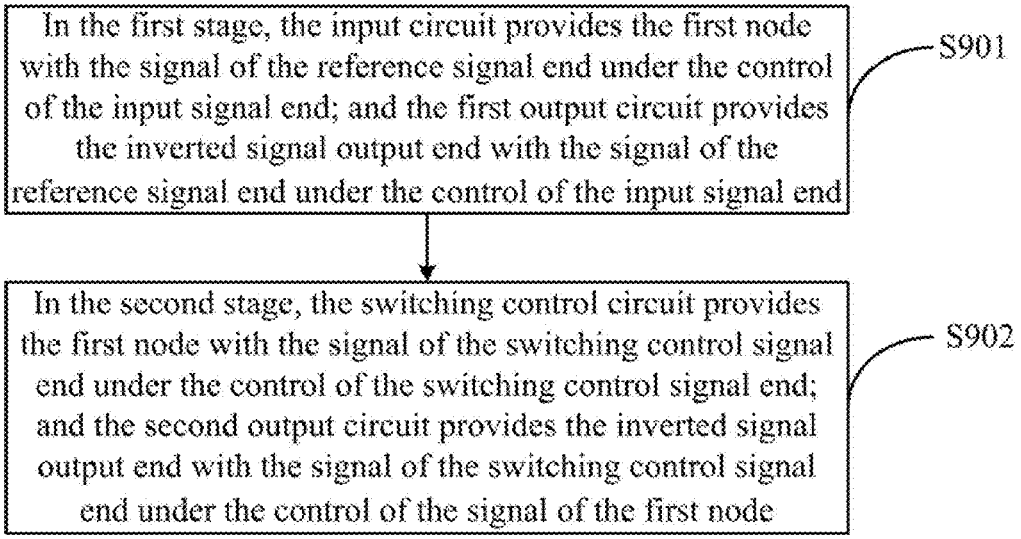
FIG. 9 is a flow chart of a method for driving the inversion control circuit illustrated in FIG. 4.

An embodiment of the present disclosure further provides a method for driving the inversion control circuit above according to the embodiment of the present disclosure, and as illustrated in FIG. 9, the method includes a first stage and a second stage.

In the step S901, in the first stage, the input circuit provides the first node with the signal of the reference signal end under the control of the input signal end; and the first output circuit provides the inverted signal output end with the signal of the reference signal end under the control of the input signal end.

In the step S902, in the second stage, the switching control circuit provides the first node with the signal of the switching control signal end under the control of the switching control signal end; and the second output circuit provides the inverted signal output end with the signal of the switching control signal end under the control of the signal of the first node.

Figure 10A:
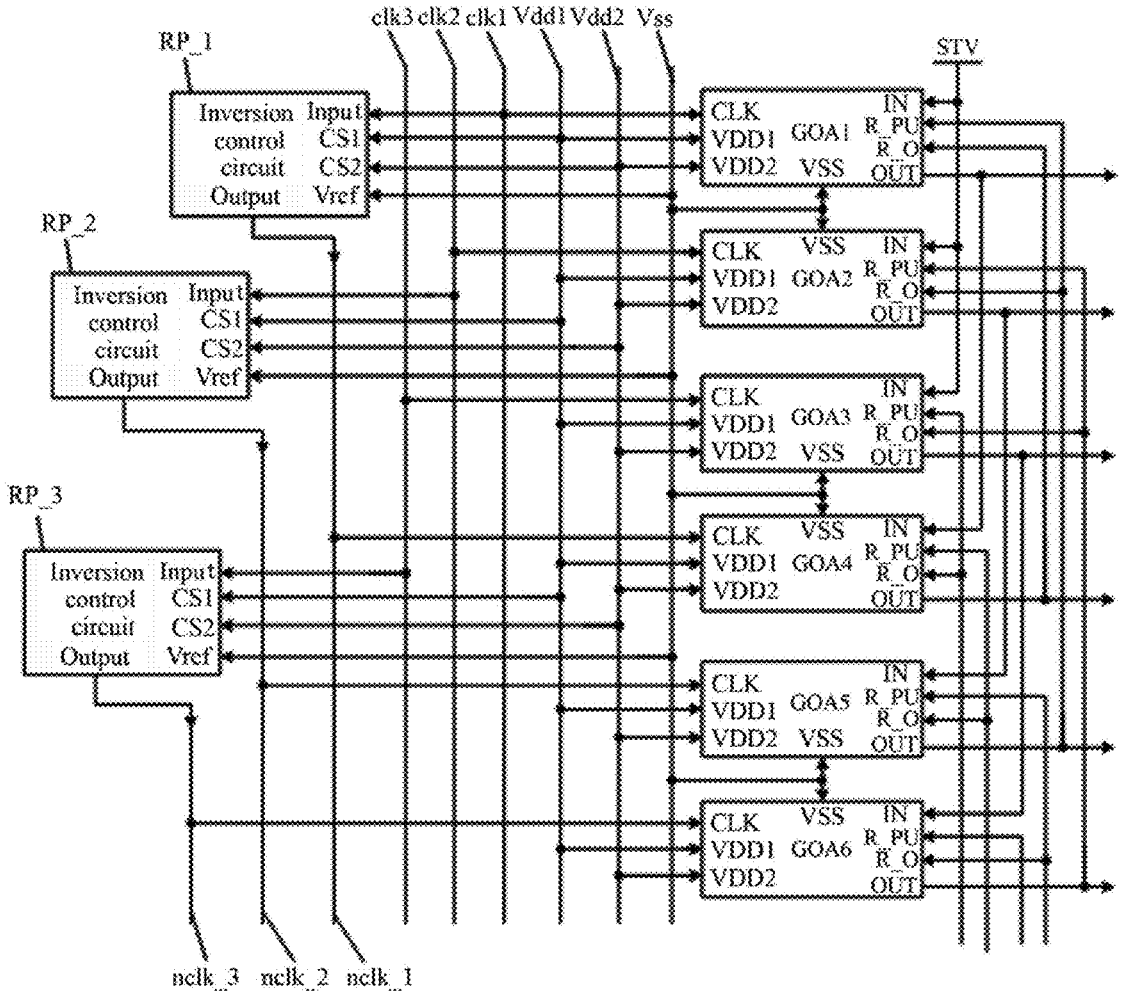
FIG. 10*a* is a first schematic structural diagram of a display panel according to an embodiment of the present disclosure.
Figure 10B:
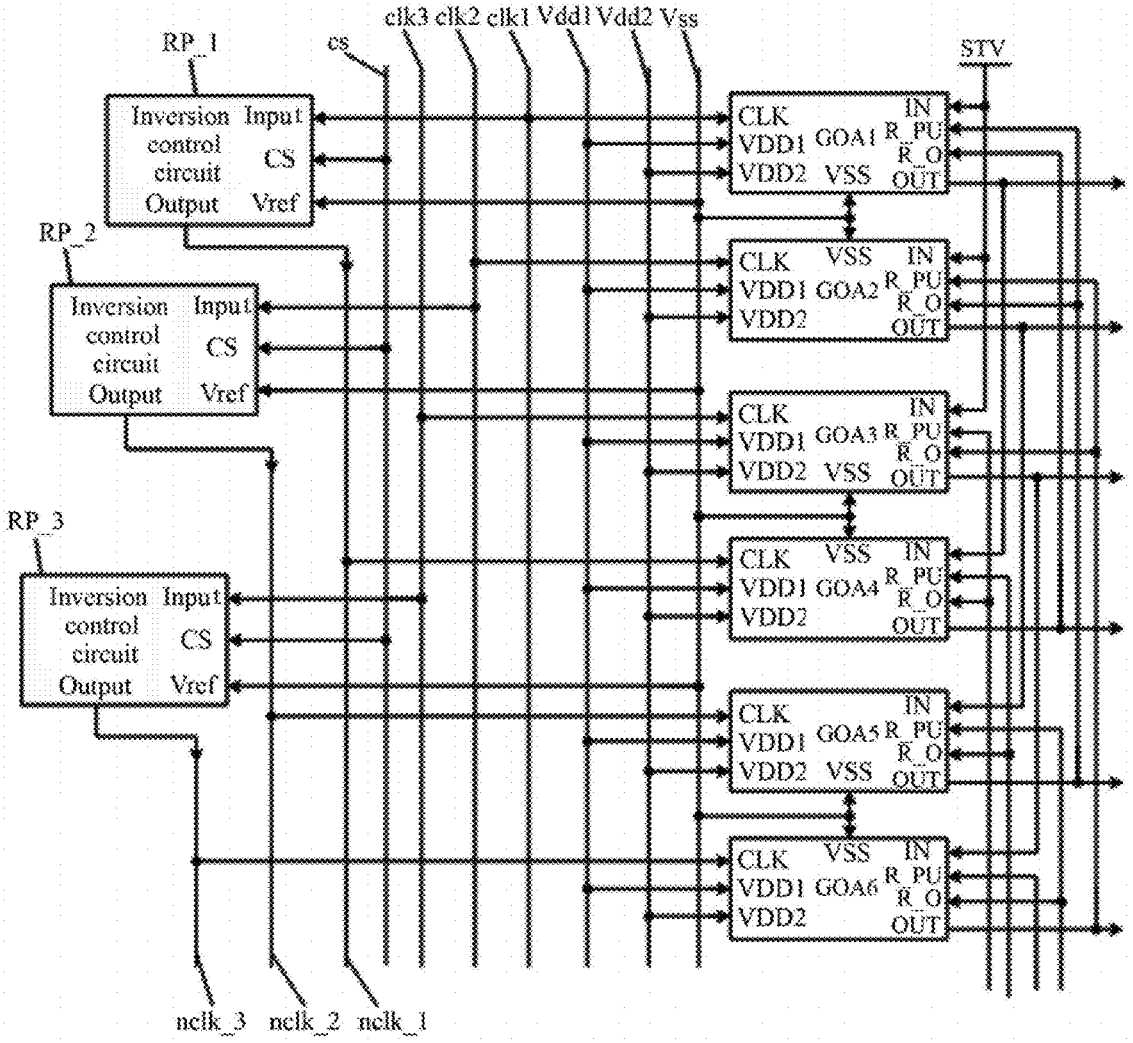
FIG. 10*b* is a second schematic structural diagram of a display panel according to an embodiment of the present disclosure.

An embodiment of the present disclosure further provides a display panel as illustrated in FIG. 10*a* and FIG. 10*b*, including: at least one clock signal line clk_m (m is an integer more than or equal to 1, and less than or equal to M, where M is the total number of clock signal lines), and further including inverted clock signal lines nclk_m corresponding to the respective clock signal lines clk_m in a one-to-one manner, and the inversion control circuits RP_m according to any one of the embodiments of the present disclosure corresponding to the respective clock signal lines clk_m in a one-to-one manner.

The inversion control circuits RP_m have their input signal ends Input connected with their corresponding clock signal lines clk_m, and their inverted signal output ends Output connected with their corresponding inverted clock signal lines nclk_m.

Figure 11:
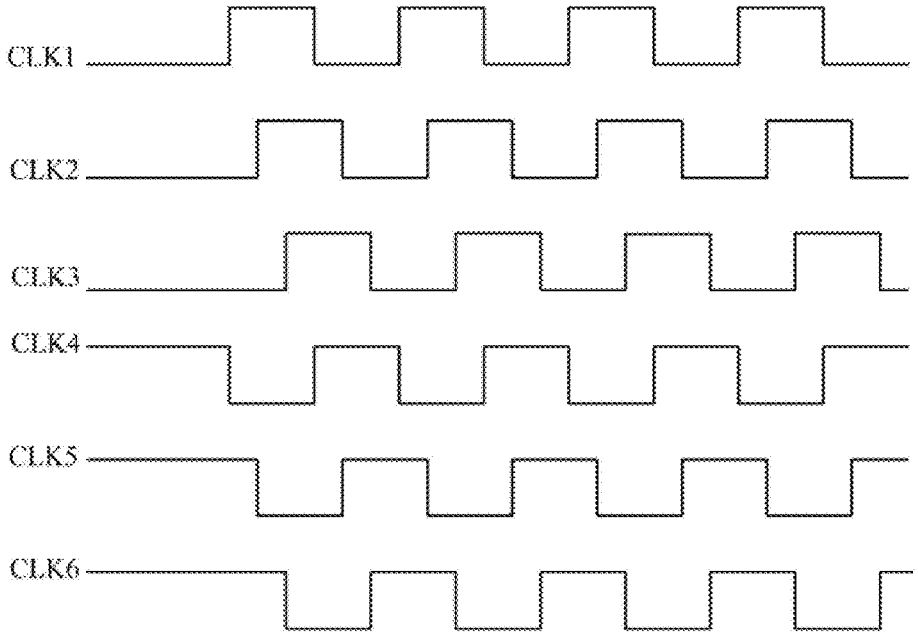
FIG. 11 is a schematic diagram of a signal in a clock signal line and a signal in an inverted clock signal line in a display panel according to an embodiment of the present disclosure.

In the display panel according to the embodiment of the present disclosure, since the clock signal lines clk_m are connected with their corresponding inverted clock signal lines nclk_m through the inversion control circuits RP_m, as illustrated in FIG. 11, after the clock signal CLK1 is input to the clock signal line clk_1, a signal on its corresponding inverted clock signal line nclk_1 is the clock signal CLK4; after the clock signal CLK2 is input to the clock signal line clk_2, a signal on its corresponding inverted clock signal line nclk_2 is the clock signal CLK5; and after the clock signal CLK3 is input to the clock signal line clk_3, a signal on its corresponding inverted clock signal line nclk_3 is the clock signal CLK6, so that the signals on the clock signal lines can made opposite, e.g., totally or substantially opposite, in potential to the signals on their corresponding inverted clock signal lines to thereby alleviate the capacitance-coupled voltage of the clock signals as a whole. Furthermore the number of clock signal lines can be halved using the inversion control circuits to thereby save a layout space of wiring for an edge frame.

In the display panel according to some embodiment of the present disclosure, scan signals are input to gates in the GOA-enabled display panel through a gate driver circuit in the display panel to thereby switch on and charge pixels. As illustrated in FIG. 10*a* and FIG. 10*b*, the gate driver circuit is typically consisted of a plurality of concatenated shift register elements GOA1, GOA2, GOA3, . . . , and scan signals are input to respective rows of gate lines on the display panel in sequence through the respective levels of shift register elements. The respective levels of shift register elements each can include a first reference signal end VDD1, a second reference signal end VDD2, a third reference signal end VSS, a clock signal end CLK, a concatenated signal input end IN, and a scan signal output end OUT, where the respective levels of shift register elements have their first reference signal ends VDD1 connected with the same signal line Vdd1 for inputting a first reference signal, their second reference signal ends VDD2 connected with the same signal line Vdd2 for inputting a second reference signal, and their third reference signal ends VSS connected with the same signal line Vss for inputting a third reference signal. In a real application, in order to reduce the number of signal lines, the signal on the signal line Vdd1 and the signals of the first switching control signal ends CS1 can be set as the same type of signal, that is, the signal line Vdd1 is connected with the first switching control signal ends CS1; the signal on the signal line Vdd2 and the signals of the second switching control signal ends CS2 can be set as the same type of signal, that is, the signal line Vdd2 is connected with the second switching control signal ends CS2; and the signal on the signal line Vss and the signals of the reference signal ends Vref can be set as the same type of signal, that is, the signal line Vss is connected with the reference signal ends Vref. Furthermore the setting of the signals input to the shift registers above can be the same as in the prior art, and shall be appreciated by those ordinarily skilled in the art, so a repeated description thereof will be omitted here, and the embodiment of the present disclosure will not be limited thereto.

In the display panel according to some embodiment of the present disclosure, as illustrated in FIG. 10*a*, FIG. 10*b* and FIG. 11, when the clock signals CLK1, CLK2, and CLK3 are input respectively to the clock signal lines clk_1, clk_2, and clk3, all of the clock signal ends CLK of the (6k-5)-th level of shift register elements are connected with the same clock signal line clk_1, all of the clock signal ends CLK of the (6k-4)-th level of shift register elements are connected with the same clock signal line clk_2, all of the clock signal ends CLK of the (6k-3)-th level of shift register elements are connected with the same clock signal line clk_3, all of the clock signal ends CLK of the (6k-2)-th level of shift register elements are connected with the same inverted clock signal line nclk_1, all of the clock signal ends CLK of the (6k-1)-th level of shift register elements are connected with the same inverted clock signal line nclk_2, and all of the clock signal ends CLK of the 6k-th level of shift register elements are connected with the same inverted clock signal line nclk_3, where k is a positive integer.

Figure 12:
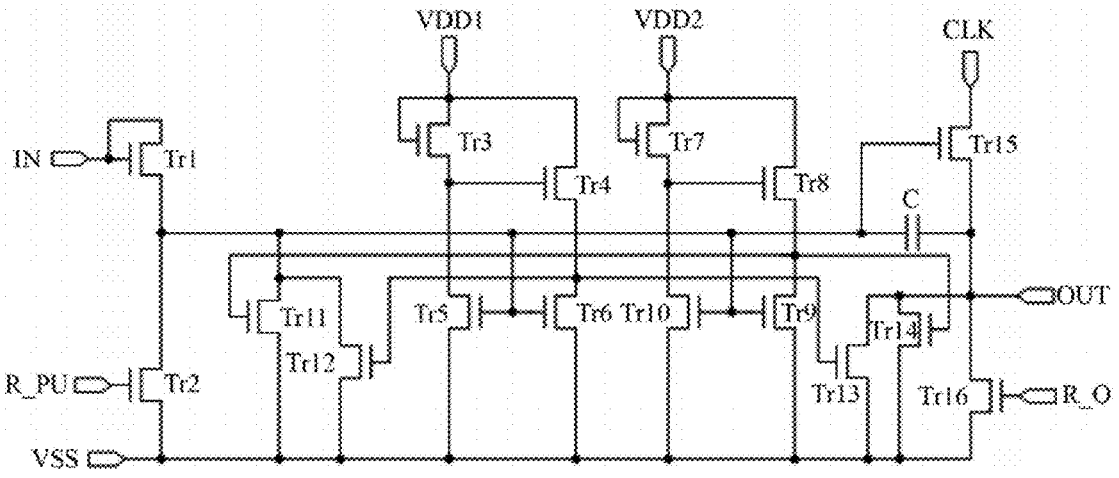
FIG. 12 is a particular schematic structural diagram of a shift register element in a display panel according to an embodiment of the present disclosure.

In the display panel according to some embodiment of the present disclosure, as illustrated in FIG. 12, the shift register elements each can include sixteen input transistors, which are the first input transistor Tr1 to the sixteenth input transistor Tr16 respectively. Their particular connection modes and driving schemes can be the same as in the related art, and shall be appreciated by those ordinarily skilled in the art, so a repeated description thereof will be omitted here, and the embodiment of the present disclosure will not be limited thereto.

In the display panel according to some embodiment of the present disclosure, as illustrated in FIG. 10*a* and FIG. 10*b*, the display panel includes at most three clock signal lines, which are the clock signal line clk_1, the clock signal line clk_2, and the clock signal line clk_3 respectively. Of course, the display panel can alternatively include more than three clock signal lines in a real application.

In the display panel according to some embodiment of the present disclosure, as illustrated in FIG. 10*a* and FIG. 10*b*, the display panel includes three clock signal lines.

In the display panel according to some embodiment of the present disclosure, all of the respective clock signal lines, the respective inverted clock signal lines and the respective inversion control circuits are located in a non-display area of the display panel.

An embodiment of the present disclosure further provides a display device including the display panel above according to the embodiment of the present disclosure. The display device can be a mobile phone, a tablet computer, a TV set, a monitor, a notebook computer, a digital photo frame, a navigator, or any other product or component with a display function. All the other components indispensable to the display device shall be appreciated by those ordinarily skilled in the art, so a repeated description thereof will be omitted here, and the embodiments of the present disclosure shall not be limited thereto. Reference can be made to the embodiments of the display panel and the inversion control circuit above for an implementation of the display device, so a repeated description thereof will be omitted here.

In the inversion control circuit, the method for driving the same, the display panel, and the display device according to the embodiments of the present disclosure, the inversion control circuit includes: the input circuit, the switching control circuit, the first output circuit and the second output circuit, where the four circuits above cooperate with each other to thereby enable the potential of the input signal end to be opposite to the potential of the inverted signal output end, so that when the inversion control circuit is applicable to the display panel, a clock signal is used as an input signal, and an output signal is a clock signal opposite in phase.

Evidently those skilled in the art can make various modifications and variations to the present disclosure without departing from the spirit and scope of the present disclosure. Thus the present disclosure is also intended to encompass these modifications and variations thereto so long as the modifications and variations come into the scope of the claims appended to the present disclosure and their equivalents.

The invention claimed is:

1. An inversion control circuit, comprising an input circuit, a switching control circuit, a first output circuit, and a second output circuit, wherein:

the input circuit is connected respectively with an input signal end, a reference signal end, a first node and a second node, and the input circuit is configured to provide the first node and the second node respectively with a signal of the reference signal end under the control of the input signal end;

the switching control circuit is connected respectively with a first switching control signal end, a second switching control signal end, the first node and the second node, and the switching control circuit is configured to provide the first node with a signal of the first switching control signal end under the control of the first switching control signal end, and to provide the second node with a signal of the second switching control signal end under the control of the second switching control signal end;

the first output circuit is connected respectively with the input signal end, the reference signal end and an inverted signal output end of the inversion control circuit, and the first output circuit is configured to provide the inverted signal output end with the signal of the reference signal end under the control of the input signal end; and the second output circuit is connected respectively with the first switching control signal end, the second switching control signal end, the first node, the second node and the inverted signal output end, and the second output circuit is configured to provide the inverted signal output end with the signal of the first switching control signal end under the control of a signal of the first node, and to provide the inverted signal output end with the signal of the second switching control signal end under the control of a signal of the second node.

2. The inversion control circuit according to claim 1, wherein the potential of the first switching control signal end is an opposite potential in each adjacent preset interval length of time;

the potential of the first switching control signal end and the potential of the second switching control signal end are opposite potentials; and the preset interval length of time is a period of time in which N frames are displayed, and N is an integer more than or equal to 1.

3. The inversion control circuit according to claim 1, wherein the potential of a valid pulse signal of the input signal end is a high potential, and the potential of the reference signal end is a low potential; or the potential of a valid pulse signal of the input signal end is a low potential, and the potential of the reference signal end is a high potential.

4. The inversion control circuit according to claim 1, wherein the switching control circuit comprises a first switch transistor and a second switch transistor, wherein:

the first switch transistor has both a control electrode and a first electrode connected with the first switching control signal end, and a second electrode connected with the first node; and the second switch transistor has both a control electrode and a first electrode connected with the second switching control signal end, and a second electrode connected with the second node.

5. The inversion control circuit according to claim 4, wherein the input circuit comprises a third switch transistor and a fourth switch transistor, wherein:

the third switch transistor has a control electrode connected with the input signal end, a first electrode connected with the reference signal end, and a second electrode connected with the first node; and the fourth switch transistor has a control electrode connected with the input signal end, a first electrode connected with the reference signal end, and a second electrode connected with the second node.

6. The inversion control circuit according to claim 1, wherein the first output circuit comprises a fifth switch transistor, wherein:

the fifth switch transistor has a control electrode connected with the input signal end, a first electrode connected with the reference signal end, and a second electrode connected with the inverted signal output end.

7. The inversion control circuit according to claim 6, wherein the second output circuit comprises a sixth switch transistor and a seventh switch transistor, wherein:

the sixth switch transistor has a control electrode connected with the first node, a first electrode connected with the first switching control signal end, and a second electrode connected with the inverted signal output end; and the seventh switch transistor has a control electrode connected with the second node, a first electrode connected with the second switching control signal end, and a second electrode connected with the inverted signal output end.

8. A method for driving the inversion control circuit according to claim 1, the method comprising:

in the first stage, providing, by the input circuit, the first node and the second node respectively with the signal of the reference signal end under the control of the input signal end; and providing, by the first output circuit, the inverted signal output end with the signal of the reference signal end under the control of the input signal end; and in the second stage, providing, by the switching control circuit, the first node with the signal of the first switching control signal end under the control of the first switching control signal end; and providing, by the second output circuit, the inverted signal output end with the signal of the first switching control signal end under the control of the signal of the first node; or in the second stage, providing, by the switching control circuit, the second node with the signal of the second switching control signal end under the control of the second switching control signal end; and providing, by the second output circuit, the inverted signal output end with the signal of the second switching control signal end under the control of the signal of the second node.

9. A display panel, comprising at least one clock signal line, wherein the display panel further comprises: inverted clock signal lines corresponding to the respective clock signal lines in a one-to-one manner, and the inversion control circuits according claim 1 corresponding to the respective clock signal lines in a one-to-one manner; and the inversion control circuits have their input signal ends connected with their corresponding clock signal lines, and their inverted signal output ends connected with their corresponding inverted clock signal lines.

10. The display panel according to claim 9, wherein the display panel further comprises a gate driver circuit consisted of a plurality of concatenated shift register elements;

the respective levels of shift register elements have their first reference signal ends connected with the same signal line configured to input a first reference signal, their second reference signal ends connected with the same signal line configured to input a second reference signal, and their third reference signal ends connected with the same signal line configured to input a third reference signal; and the signal line configured to input the first reference signal is connected with the first switching control signal ends of the inversion control circuits, the signal line configured to input the second reference signal is connected with the second switching control signal ends of the inversion control circuits, and the signal line configured to input the third reference signal is connected with the reference signal ends of the inversion control circuits.

11. The display panel according to claim 9, wherein the display panel comprises at most three clock signal lines.

12. The display panel according to claim 9, wherein the respective clock signal lines, the respective inverted clock signal lines, and the respective inversion control circuits are located in a non-display area of the display panel.

13. A display device, comprising the display panel according claim 9.

14. An inversion control circuit, comprising: an input circuit, a switching control circuit, a first output circuit, and a second output circuit, wherein:

the input circuit is connected respectively with an input signal end, a reference signal end and a first node, and the input circuit is configured to provide the first node with a signal of the reference signal end under the control of the input signal end;

the switching control circuit is connected respectively with a switching control signal end and the first node, and the switching control circuit is configured to provide the first node with a signal of the switching control signal end under the control of the switching control signal end;

the first output circuit is connected respectively with the input signal end, the reference signal end and an inverted signal output end of the inversion control circuit, and the first output circuit is configured to provide the inverted signal output end with the signal of the reference signal end under the control of the input signal end; and the second output circuit is connected respectively with the switching control signal end, the first node and the inverted signal output end, and the second output circuit is configured to provide the inverted signal output end with the signal of the switching control signal end under the control of a signal of the first node.

15. The inversion control circuit according to claim 14, wherein the potential of a valid pulse signal of the input signal end is a high potential, the potential of the reference signal end is a low potential, and the potential of the switching control signal end is a high potential; or the potential of a valid pulse signal of the input signal end is a low potential, the potential of the reference signal end is a high potential, and the potential of the switching control signal end is a low potential.

16. The inversion control circuit according to claim 14, wherein the switching control circuit comprises a first switch transistor, wherein:

the first switch transistor has both a control electrode and a first electrode connected with the switching control signal end, and a second electrode connected with the first node.

17. The inversion control circuit according to claim 16, wherein the input circuit comprises a second switch transistor, wherein:

the second switch transistor has a control electrode connected with the input signal end, a first electrode connected with the reference signal end, and a second electrode connected with the first node.

18. The inversion control circuit according to claim 14, wherein the first output circuit comprises a third switch transistor, wherein:

the third switch transistor has a control electrode connected with the input signal end, a first electrode connected with the reference signal end, and a second electrode connected with the inverted signal output end.

19. The inversion control circuit according to claim 18, wherein the second output circuit comprises a fourth switch transistor, wherein:

the fourth switch transistor has a control electrode connected with the first node, a first electrode connected with the switching control signal end, and a second electrode connected with the inverted signal output end.

20. A method for driving the inversion control circuit according to claim 14, the method comprising:

in the first stage, providing, by the input circuit, the first node with the signal of the reference signal end under the control of the input signal end; and providing, by the first output circuit, the inverted signal output end with the signal of the reference signal end under the control of the input signal end; and in the second stage, providing, by the switching control circuit, the first node with the signal of the switching control signal end under the control of the switching control signal end; and providing, by the second output circuit, the inverted signal output end with the signal of the switching control signal end under the control of the signal of the first node.

* * * * *